US007431881B2

(12) United States Patent
Mazumder

(10) Patent No.: US 7,431,881 B2
(45) Date of Patent: Oct. 7, 2008

(54) WEAR-RESISTANT ALLOYS PARTICULARLY SUITED TO ALUMINUM-ENGINE HEAD-VALVE SEATS

(75) Inventor: Jyoti Mazumder, Ann Arbor, MI (US)

(73) Assignee: The P.O.M. Group, Auburn Hills, MI (US)

( * ) Notice: Subject to any disclaimer, the term of this patent is extended or adjusted under 35 U.S.C. 154(b) by 504 days.

(21) Appl. No.: 10/784,433

(22) Filed: Feb. 23, 2004

(65) Prior Publication Data

US 2005/0031892 A1 Feb. 10, 2005

Related U.S. Application Data

(60) Provisional application No. 60/449,177, filed on Feb. 21, 2003.

(51) Int. Cl.
*C22C 9/05* (2006.01)

(52) U.S. Cl. ..... 420/487; 148/435

(58) Field of Classification Search ..... 420/487; 148/435

See application file for complete search history.

(56) References Cited

U.S. PATENT DOCUMENTS

| | | | | |
|---|---|---|---|---|
| 5,188,799 | A | 2/1993 | Mori et al. | 420/469 |
| 5,843,243 | A | 12/1998 | Kawasaki et al. | 148/435 |
| 6,122,564 | A | 9/2000 | Koch et al. | 700/123 |
| 6,531,003 | B2 * | 3/2003 | Ninomiya et al. | 148/435 |

FOREIGN PATENT DOCUMENTS

| | | | |
|---|---|---|---|
| JP | 61183426 | * | 8/1986 |

* cited by examiner

*Primary Examiner*—Sikyin Ip
(74) *Attorney, Agent, or Firm*—Gifford, Krass, Sprinkle, Anderson & Citkowski, PC

(57) ABSTRACT

A thermally conductive, wear-resistant alloy is particularly suited to cladding aluminum engine head valve seats. In the preferred embodiments, the alloys are metallurgically compatible with the cast Al—Si alloy used for the engine head. Three alternative embodiments are disclosed, namely, copper-based alloys; aluminum silicon-based alloys; and two-layer systems.

2 Claims, No Drawings

WEAR-RESISTANT ALLOYS PARTICULARLY SUITED TO ALUMINUM-ENGINE HEAD-VALVE SEATS

REFERENCE TO RELATED APPLICATION

This application claims priority from U.S. Provisional Patent Application Ser. No. 60/449,177, filed Feb. 21, 2003, the entire content of which is incorporated herein by reference.

FIELD OF THE INVENTION

This invention relates generally to laser-based material-deposition processes and, in particular, to a thermally conductive, wear-resistant alloy for cladding aluminum engine head valve seats which is metallurgically compatible with the cast Al—Si alloy used for the engine head.

BACKGROUND OF THE INVENTION

In laser cladding, a laser is used to generate a melt-pool on a substrate material while a second material, typically a powder or wire, is introduced, melted, and metallurgically joined. Cladding is generally distinguished from alloying on the basis that cladding melts a relatively small amount of the base substrate material relative to the amount of the deposited material, and the powder system delivers a controlled volume of metal particles into this molten volume. The particles become dispersed throughout this molten volume and form a deposition of a desired composition on the outer layer of the substrate. Removal of the laser beam from the molten volume, such as by advancement of the substrate workpiece relative to the focal point of the beam, causes the molten volume to be rapidly chilled. The chilling occurs so rapidly that the volume often retains the characteristics of the molten mix.

Conventional laser cladding techniques move the metal article relative to the focal point through the use of jigs, parts handlers, and the like. The beam focal point therefore remains fixed in space, as does the powdering point. Uniform movement of the metal article usually requires a complicated jig which is difficult to manufacture, very expensive, and usually not very successful, particularly with intricate geometries. For this reason, laser cladding of metal parts having other than relatively flat geometries have been nearly impossible to achieve on a consistent uniform basis. To the present time, it has not been possible to control the dimension and properties of the deposit. Close control of dimension is necessary in order to apply the basic cladding technique to the production of parts having close tolerances, acceptable microstructures and properties, and which can be produced at a reasonable cost and within a reasonable period of time.

The system described in U.S. Pat. No. 6,122,564, incorporated herein by reference, is useful in automatically controlling the build-up of material on a substrate, and is particularly useful in fabricating metal parts through repetitive cladding operations as might be required for small volume manufacturing, prototype runs, and the like. Using this approach, called closed-loop direct-metal deposition (DMD), a laser is used to locally heat a spot on a substrate, forming a melt pool into which powder is fed to create a deposit having a physical dimension. Optical detection is used to monitor a physical dimension of the deposit, and a feedback controller is operative to adjust the laser, thereby controlling the rate of material deposition. In the preferred embodiment, the physical dimension is the height of the deposit, and the system further includes an interface to a computer-aided design (CAD) system including a description of an article to be fabricated, enabling the feedback controller to compare the physical dimension of the deposit to the description and adjust the energy of the laser in accordance therewith.

With laser cladding and DMD, melting a thin layer of the substrate is necessary to form a metallurgical bonding between the clad and the substrate. There are two undesirable situations: one situation is that the clad is not metallurgically bonded to the substrate and that no continuous interface is formed, and the other is that a large amount of the substrate is melted to cause dilution to the clad. Large dilution resulting from melting of the substrate is not desirable because the properties of the clad may degrade due to composition change. Also, intermetallic compounds may form at the interface and make the interface brittle as will be shown in this study. In a good clad, the amount of the substrate melted is just enough to create a continuous interface between the clad and the substrate.

Research into the laser cladding of Ni—Al bronze on Al alloy AA333 has been carried out by Professor Jyotirmoy Mazumder at the Center for Laser Aided Intelligent Manufacturing (CLAIM) at the University of Michigan. The two materials were chosen because the Ni—Al bronze has a good wear resistance up to a temperature of 250° C. and is easily machined, while Al alloy AA333 has a low density and good casting properties. The microstructure of the cladding has been studied using microdiffraction (MD), convergent beam electron diffraction, and high-resolution electron microscopy.

The effects of processing parameters on clad formation of Ni—Al bronze on Al alloy AA333 have been identified; however, the significant difference in melting temperature between the cladding material Ni—Al bronze (melting point=1063° C.) and the substrate Al alloy AA333 (melting point=577° C.) creates a strong tendency toward large dilution. Large dilution can cause cracking at the interface in the following cases: (1) cladding layer thinner than 1 mm, (2) starting portion and ending portion of a clad track, and (3) overpowered clad tracks. The tendency of the interface to crack depends on the magnitude of thermal stresses and the toughness of the interface.

The present Ni—Al bronze contains about 10 weight percent Al and the Al alloy AA333 contains about 87 weight percent Al. Since the two materials must be metallurgically combined, the composition range in the interface must vary from 10 weight percent Al to 87 weight percent Al, which lies in the most complicated region in the Cu—Al system. There exist many intermetallic compounds and phase transformations in solid state in the Cu—Al system. Therefore, examination of the microstructure and crystal structure of the interface is necessary to understand the mechanical behavior of the interface. In Ni—Al bronze system formation of martensite and hard precipitates such as suicides were the main contributors for wear resistance.

In the alloy patented by Toyota (U.S. Pat. No. 5,188,799, February 1993; U.S. Pat. No. 5,843,243, December 1998) and Nissan (U.S. Pat. No. 5,911,949, June 1999), formation of precipitates such as silicides and hard phases were also identified as the main contributors for the wear resistance. The three patents above cover most of the obvious hard phase formers in the periodic table and thus offer a challenge to develop an alternative alloy for the integral valve seat application.

SUMMARY OF THE INVENTION

This invention broadly resides in providing a thermally conductive, wear-resistant alloy which is particularly suited to cladding aluminum engine head valve seats. In the preferred embodiments, the alloys are metallurgically compatible with the cast Al—Si alloy used for the engine head. Although closed-loop DMD is the preferred deposition technology other suitably controlled/monitored laser-cladding/-deposition techniques may be used.

Three alternative embodiments are disclosed, including copper-based alloys; aluminum silicon-based alloys; and two-layer systems. A first preferred copper alloy comprises:

30 to 50 weight percent nickel;
2 to 6 weight percent silicon;
1 to 10 weight percent iron;
1 to 10 weight percent chromium;
1 to 10 weight percent of at least one element selected from the group consisting of: Mo, W, Ti, Zr, Nb and V;
1 to 10 weight percent manganese;
1 to 3 weight percent yttrium and/or hafnium; and
a balance of copper.

A second preferred copper alloy comprises:

5 to 15 weight percent nickel;
2 to 6 weight percent silicon;
1 to 10 weight percent iron;
1 to 10 weight percent chromium;
1 to 10 weight percent of at least one element selected from the group consisting of: Mo, W, Ti, Zr, Nb and V;
1 to 10 weight percent manganese;
1 to 3 weight percent yttrium and/or hafnium; and
a balance of copper.

A third preferred copper alloy comprises:

2 to 5 weight percent nickel;
1 to 3 weight percent silicon;
1 to 3 weight percent iron;
10 to 15 weight percent manganese; and
a balance of copper.

Disclosed alternative embodiments include an aluminum silica alloy containing silicide and carbide formation centers, and a metal system having at least two layers comprising a copper alloy as a bond coat between a substrate having a predominance of aluminum and a nickel alloy.

DETAILED DESCRIPTION OF THE INVENTION

Three different approaches are described for the development of wear resistant alloys for integral valve seats. These involve copper-based alloys; aluminum silicon-based alloys; and two-layer systems. Each approach will be described in turn.

Copper-Based Alloys

In copper-based alloys, two different strategies are followed according to the invention. One relies on a nickel content exceeding 30 percent. Copper and nickel are 100 percent miscible and adding additional nickel does not pose any metallurgical problem. However, the price for higher alloying content in copper-based alloys is reduced thermal conductivity which is also a critical property for better engine performance. Therefore, the second strategy is to choose a simpler ternary system with a strong hard-face former. In both groups, the reactive trace elements such as yttrium and hafnium will be used to control the oxygen.

Three compositions are disclosed. Two will contain higher alloying elements and two will be simpler ternary systems. The three classes of inventive copper alloys are as follows:

| | Alloy 1 | Alloy 2 | Alloy 3 |
|---|---|---|---|
| Ni | 30-50% | 5-15% | 2-5% |
| Si | 2-6% | 2-6% | 1-3% |
| Fe | 1-10% | 1-10% | 1-3% |
| Cr | 1-10% | 1-10% | |
| Mo, W, Ti, Zr, Nb, V | 1-10% | 1-10% | |
| Mn | 1-10% | 1-10% | 10-15% |
| Y, Hf | 1-3% | 1-3% | |
| Cu | balance | balance | balance |

Aluminum Silicon-Based Alloys

Selection and identification of aluminum-based alloys alleviates the problems related to the copper based alloy patents referenced in the prior art. In addition, cladding of aluminum alloy as an overlay on another aluminum alloy minimizes crack initiation, a serious problem for cladding of copper based alloys. Al—Si systems with silicide and silicon carbide formers are inventive compositions. However, the biggest drawback for aluminum system is the low melting point and thus, lower operating temperature. This class of inventive alloys is more suitable for inlet valve than exhaust valves. High silicon content alloys are preferred for higher temperature operation.

Two-Layer System

In this approach, a copper alloy is used to provide a "bond coat" between the Al-substrate and a nickel alloy. A series of nickel-based, wear-resistant alloys and Cu-based alloys were explored. Since two layers may take a longer time to deposit than a single layer, process parameters are optimized to obtain a higher deposition speed for each layer, so that two-layer deposition time is as close to single layer deposition time as possible. Since each layer requires thickness approximately half of a single layer, higher speed methods of deposition are preferred. More preferably, the deposition method involves software and hardware for a quick powder change.

I claim:

1. A copper alloy comprising:
6 to 15 weight percent nickel;
2 to 6 weight percent silicon;
1 to 10 weight percent iron;
1 to 10 weight percent chromium;
1 to 10 weight percent of at least one element selected from the group consisting of: Mo, W, Ti, Zr, Nb and V;
1 to 3 weight percent yttrium and/or hafnium; and
a balance of copper.

2. A cast Al—Si alloy engine head having a valve seat constructed through the deposition of the alloy of claim 1.

* * * * *